US011139586B2

(12) United States Patent
Mössinger

(10) Patent No.: US 11,139,586 B2
(45) Date of Patent: Oct. 5, 2021

(54) ANTENNA COMPRISING A PLURALITY OF INDIVIDUAL RADIATORS

(71) Applicant: LISA DRÄXLMAIER GMBH, Vilsbiburg (DE)

(72) Inventor: Alexander Mössinger, Tübingen (DE)

(73) Assignee: LISA DRÄXLMAIER GMBH, Vilsbiburg (DE)

( * ) Notice: Subject to any disclaimer, the term of this patent is extended or adjusted under 35 U.S.C. 154(b) by 74 days.

(21) Appl. No.: 16/705,164

(22) Filed: Dec. 5, 2019

(65) Prior Publication Data

US 2020/0169003 A1 May 28, 2020

Related U.S. Application Data

(63) Continuation of application No. PCT/DE2018/100419, filed on May 3, 2018.

(30) Foreign Application Priority Data

Jun. 7, 2017 (DE) ..... 10 2017 112 552.3

(51) Int. Cl.
*H01Q 21/06* (2006.01)
*H01Q 1/52* (2006.01)
(Continued)

(52) U.S. Cl.
CPC ..... *H01Q 21/064* (2013.01); *H01Q 1/523* (2013.01); *H01Q 3/04* (2013.01); *H01Q 3/34* (2013.01); *H01Q 13/06* (2013.01)

(58) Field of Classification Search
CPC ..... H01Q 13/02; H01Q 13/0208; H01Q 13/0216; H01Q 13/0225; H01Q 13/0233;
(Continued)

(56) References Cited

U.S. PATENT DOCUMENTS 6,034,647 A 3/2000 Paul et al.
2015/0162668 A1* 6/2015 Oppenlaender ..... H01Q 15/24 343/776
(Continued)

FOREIGN PATENT DOCUMENTS

DE 102014112485 3/2016
DE 102014112487 3/2016
(Continued)

OTHER PUBLICATIONS

International Search Report for International Application PCT/DE2018/100419, dated Jul. 27, 2018.

*Primary Examiner* — Seokjin Kim
(74) *Attorney, Agent, or Firm* — Burris Law, PLLC

(57) ABSTRACT

An antenna features a plurality of single emitters which in the x- and y-direction form an antenna array with an aperture. The single emitters are separated from each other by separating walls. At least a portion of the separating walls features an interference site that interrupts the otherwise planar aperture in the z-direction. However, the separating walls which cross the x-direction (and thus separate neighboring single emitters in the x-direction) differ from the separating walls in the y-direction with respect to their wall thickness. In addition, the single emitters feature a separation in the x-direction of less than A. The x-, y- and z-directions are each aligned orthogonal to each other. Due to the asymmetrical wall thickness the single emitters in the x-direction can be placed more closely to each other, so that when using the phase-controlled single emitters the emission characteristic can be displaced in this x-direction.

20 Claims, 2 Drawing Sheets

(51) Int. Cl.
*H01Q 3/34* (2006.01)
*H01Q 3/04* (2006.01)
*H01Q 13/06* (2006.01)

(58) Field of Classification Search
CPC ..... H01Q 13/0241; H01Q 13/025; H01Q 13/0258; H01Q 13/0266; H01Q 13/0275; H01Q 13/0283; H01Q 13/02991; H01Q 13/04; H01Q 13/06; H01Q 13/065; H01Q 21/064; H01Q 3/04; H01Q 3/34; H01Q 1/523
See application file for complete search history.

(56) References Cited

U.S. PATENT DOCUMENTS

| | | | | |
|---|---|---|---|---|
| 2016/0248168 | A1* | 8/2016 | Boyanov ..... | H01Q 21/064 |
| 2020/0313304 | A1* | 10/2020 | Glogowski ..... | H01Q 1/523 |

FOREIGN PATENT DOCUMENTS

| | | | | |
|---|---|---|---|---|
| DE | 102014112487 | A1 * | 3/2016 | ..... H01Q 21/064 |
| DE | 102015101721 | | 8/2016 | |
| DE | 102016112583 | | 1/2018 | |
| EP | 2159875 | | 3/2010 | |
| WO | 1999036986 | | 7/1999 | |
| WO | 2014005691 | A1 | 1/2014 | |
| WO | 2014005699 | A1 | 1/2014 | |

* cited by examiner

ANTENNA COMPRISING A PLURALITY OF INDIVIDUAL RADIATORS

CROSS-REFERENCE TO RELATED APPLICATIONS

This application is a continuation of International Application No. PCT/DE2018/100419, filed on May 3, 2018, which claims priority to and the benefit of DE 10 2017 112 552.3, filed on Jun. 7, 2017. The disclosures of the above applications are incorporated herein by reference.

FIELD

The present disclosure relates to an antenna with a plurality of single emitters. Antennas of this kind are used, for example, in Ku- and Ka-band aeronautic satellite communication.

BACKGROUND

The statements in this section merely provide background information related to the present disclosure and may not constitute prior art.

The market for wireless broadband channels for data transmission at very high data rates, especially in the field of aeronautic, that is, aircraft-based, satellite communication is growing steadily. Suitable antennas in this respect should have small dimensions and low weight, and additionally satisfy extreme demands on transmission characteristics since any disruption to neighboring satellites must be reliably precluded. Small dimensions reduce the payload of the aircraft and thus also its operating costs. Document DE 10 2014 112 487 A1 depicts an exemplary antenna as group emitter with identical horn radiators which can get by with small dimensions and radiate perpendicular to the aperture of the antenna.

A change in the radiation characteristics occurs, for example, due to a rotation and pivoting of the antenna, as is described for example in DE 10 2015 101 721 A1. However, due to the movement of the antenna, a certain volume has to be provided under a radome mounted to the aircraft, and thus aerodynamic losses are unavoidable when the device is mounted to an aircraft.

Horn radiators are suitable as single emitters in arrays and also can be designed as broad band. In regard to E-field coupling, horn radiators are stimulated with a small pin and with respect to the emitted wave-front, display minor displacements in emission characteristics from the midpoint of the horn radiator.

Thus, there is a positive interference of neighboring horn radiators of the antenna and thus the emission of electromagnetic power in undesirable ranges of spherical angle. In addition, these interferences produce resonances which cause the following problems in the range of the particular resonance frequency: the input adjustment of the horn radiator, the emission behavior (directional diagram, lobe) of the horn radiator and the cross-polarization isolation of the horn radiator are adversely affected.

The performance of the antenna is thus reduced significantly in the range of these resonance frequencies. Emission characteristics, input adjustment and resonance frequencies depend on the geometry of the horn radiator and in standard geometry can only be adjusted to a limited extent independently of each other.

In addition, electrically changing the emission characteristics of the antenna is known; in this case the phase control elements are used to adjust a phase difference between neighboring single emitters of the antenna. An exemplary phase control element is known from DE 10 2016 112 583 A1.

SUMMARY

This section provides a general summary of the disclosure and is not a comprehensive disclosure of its full scope or all of its features.

The present disclosure provides an antenna that uses a relatively simple design and has improved aerodynamic properties.

This present disclosure may be attained by the subject matter of the independent claim. Favorable refinements of the present disclosure are stated in the dependent claims, in the description and in the accompanying figures.

An antenna according to the present disclosure features a plurality of single emitters which in the x- and y-direction form an antenna array with an aperture and emits electromagnetic radiation essentially in the z-direction. The single emitters each are separated from the others by a separating wall. At least a portion of the separating walls features an interference site that interrupts the otherwise planar aperture in the z-direction. The interference site can have the shape of a pin or a rectangular protrusion or a rectangular recess.

However, the separating walls in the x-direction which cross the x-direction (and thus separate neighboring single emitters in the x-direction) differ from the separating walls in the y-direction with respect to their wall thickness. In addition, the single emitters feature a separation in the x-direction of less than A. The x-, y- and z-directions are each aligned orthogonal to each other.

Due to the asymmetrical wall thickness the single emitters in the x-direction can be placed more closely to each other than in the y-direction, so that when using the phase-controlled, single emitters the emission characteristic can be displaced in this x-direction.

A maximum spacing between two single emitters should be $d_{max}$:

$$d_{max} = \frac{\lambda}{1 + \sin \Theta_0}$$

$\lambda$: Wavelength at the maximum operating frequency $\Delta\phi$: Phase difference to the neighboring single emitter $\theta 0$: Scan angle (deflection of the radiating lobe)

It is advantageous that at least a portion of the single emitters are non-quadratic and aligned such that a greater number of single emitters can be arranged in the x-direction than in the y-direction. That is, even though the single emitter is narrower in the x-direction than in the y-direction, due to a wider separating wall in the y-direction it is provided that the impedance is similar in the x- and y-direction. This is important, as will be shown below, when different polarizations are to be emitted from the antenna, whose impedances and whose adjustment to propagation in free space are not intended to differ.

According to an additional advantageous refinement of the antenna, the single emitter in the separating wall crossing in the y-direction has a lamella structure. Thus the field is distributed, which otherwise would be weakened by the wider separating wall and would not be distributed over the entire surface, better over the entire aperture and contributes to a high antenna gain. Stated differently: the lamella structure contributes to an equal antenna gain in the x- and y-direction, in spite of any possibly smaller number of single emitters in the y-direction, by providing a surface impedance so that the electromagnetic field can be guided to the surface and thus the radiant surface is enlarged.

It is advantageous that the lamella structure features one or a plurality of grooves with a depth of less than $\lambda/4$ and greater than $\lambda/20$, in one form less than $\lambda/8$ and greater than $\lambda/12$, and in another form of about $\lambda/10$, wherein $\lambda$ is the wavelength of the electromagnetic radiation. For dimensioning of the antenna, the designer will orient $\lambda$ to the middle frequency of the used frequency band.

For adjusting the capacitance formed by the lamella structure, one groove of the lamella structure has a width of less than half, and more than one-fourth, and in one form of about one-third of the depth of the groove.

It is advantageous that the interference sites protrude from the particular separating walls. The interference sites of the separating walls in the x-direction of neighboring single emitters are wider than the interference sites of the separating walls in the y-direction of neighboring single emitters. It turns out that the interference sites are arranged advantageously centrally on the separating walls, thus are arranged symmetrical and periodic across the aperture. For example, nearly all separating walls contain interference sites so that with an appropriate dimensioning of the width and height of the interference sites, resonances in the emission behavior of the antenna can be shifted such that during emission in all relevant emission angles around the z-direction, the so-called "scan blindness" can be inhibited or greatly diminished.

The properties of the invented antenna are particularly prominent when at least a portion of the single emitters of the antenna array is phase-controlled. The phase control is provided, for example, in that the antenna is connected by a power supply to a sending/receiving device, wherein phase control elements are disposed in the power supply. Due to a compressed arrangement of the single emitters in the x-direction, it is advantageous that a control device controls the phase control elements such that a deflection of the emission characteristic of the antenna from the z-direction occurs predominately in the x-direction. The phase control element herein can be arranged near the single emitter in the power supply in order to provide a compact assembly of the antenna.

The antenna can have an especially compact design when the single emitters are designed as open waveguides. In contrast to the waveguides, the single emitters will then not have a funnel shape, that is, emission opening and waveguide cross section coincide, or are very similar, so that the single emitter is compressed and shorter in the z-direction due to omission of the funnel.

If open round waveguides are used for the single emitters, which can be connected to a power supply of round waveguides, then one can use rotation-symmetrical (and thus rotating) and low-loss phase control elements, as are described for example in DE 10 2016 112 583 A1.

An additional favorable compacting of the antenna is obtained when at least a portion of the single emitters is filled with a dielectric material. This latter has advantageously a rotation-symmetrical shape and is arranged along an emission axis of the single emitter. Thus, the dielectric material can be formed together with a dielectric material of the phase control element and can move within the single emitter. Adjustment of the impedance of the single emitter can be further improved when the dielectric material has a protrusion in the direction of the aperture. This step in the dielectric material whose diameter and height can be adjusted, improves the impedance adjustment.

If the antenna is equipped with a turntable on which the antenna array is arranged flat, then due to a rotation of the turntable and the deflection of the antenna characteristic in only one direction (the x-direction), random emission lobes can be obtained without having to tilt the antenna. Thus, the radome will be significantly smaller. If a deflection of the antenna characteristic up to 90° from the z-direction is not possible but is desired, then via a slight tilting of the antenna, the absent angle range can be compensated. For example, a tilt of the antenna array of only 20° would be sufficient to light up the entire hemisphere with an emission characteristic deflecting at up to 70° with phase shifters.

The single emitters of the antenna array of the antenna can be advantageously connected to a sending/receiving device by a power supply such that the sending/receiving device injects two signals of different polarization into the power supply, which signals can be adapted and emitted or received by the antenna.

Further areas of applicability will become apparent from the description provided herein. It should be understood that the description and specific examples are intended for purposes of illustration only and are not intended to limit the scope of the present disclosure.

DRAWINGS

In order that the disclosure may be well understood, there will now be described various forms thereof, given by way of example, reference being made to the accompanying drawings, in which.

Figure 1:
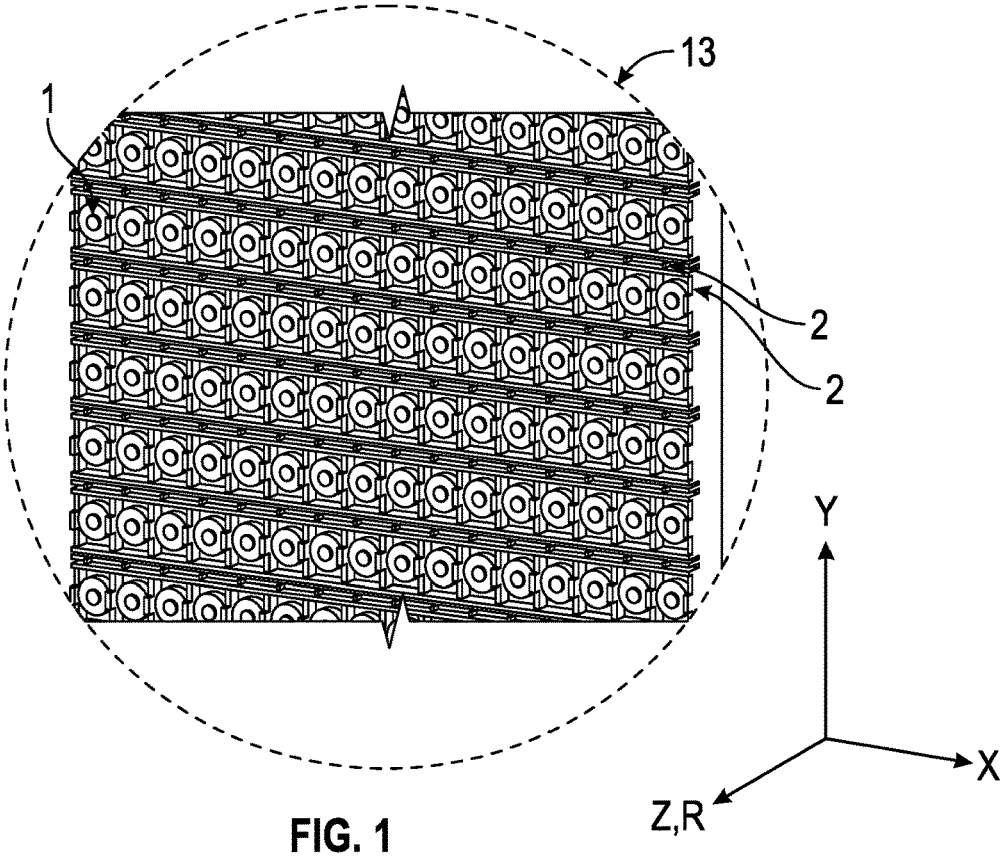
FIG. 1 is a perspective view of a section of an antenna with a plurality of single emitters and a turntable for rotation, according to the teachings of the present disclosure.

The drawings described herein are for illustration purposes only and are not intended to limit the scope of the present disclosure in any way.

DETAILED DESCRIPTION

The following description is merely exemplary in nature and is not intended to limit the present disclosure, application, or uses. It should be understood that throughout the drawings, corresponding reference numerals indicate like or corresponding parts and features.

A plurality of single emitters 1, which are arranged in an antenna array neighboring each other in the x- and y-direction, together with a turntable 13 which is depicted only schematically, forms an antenna according to FIG. 1. The turntable 13 can rotate and thereby move the antenna array to any particular angle of rotation. The single emitters 1 are each separated from each other in the x- and y-direction by separating walls 2. The shape and width of the separating walls 2 differ from each other in the x- and y-direction, as explained below.

The surface of the antenna aligned in the z-direction forms an aperture of the antenna for the electromagnetic radiation in emission direction R, which is emitted in the z-direction or at a deflection of up to 70° from the z-direction. As will be explained below, a deflection of the emission characteristic, in particular of one main lobe, is planned, so that in fact the emission direction R can differ from the z-direction by one scan angle.

The antenna array is essentially square wherein in the x-direction a greater number of single emitters 1 is arranged than in the y-direction. This is made possible because the single emitters 1 are themselves not square, but rather are more slender in the x-direction than in the y-direction. Thus, the distance between the single emitters 1 in the x-direction is also less than in the y-direction.

$$d_{max} = \frac{\lambda}{1 + \sin \Theta_0}$$

In the x-direction the spacing in one form should not exceed $d_{max}$. If this value is exceeded, then interfering grating lobes are produced in the direction diagram. The larger the desired pivot range, the smaller the spacing must be. The spacing of the single emitters 1 in the y-direction is greater than in the x-direction but is still less than the wavelength λ of the maximum operating frequency.

Figure 2:
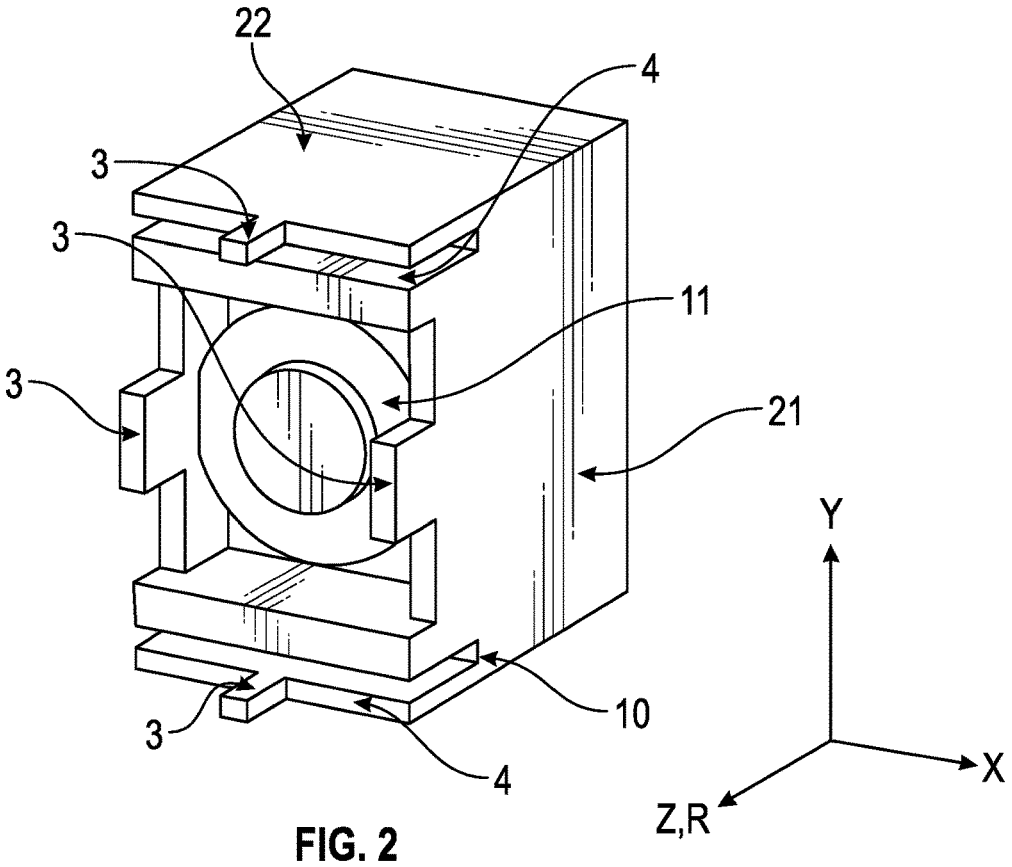
FIG. 2 is a perspective view of a single emitter, according to the teachings of the present disclosure.

The single emitters 1 according to FIG. 2 have an identical design, wherein the separating walls 21 are slenderer in the x-direction than the separating walls 22 in the y-direction. As is again illustrated in FIG. 3, the wall thickness d of the separating wall 21 is smaller in the x-direction (the separating wall 21 crosses the x-direction and is positioned perpendicular thereto) than the wall thickness d of the separating wall 22 in the y-direction. The greater wall thickness d in the y-direction is used for a lamella structure 4 in the separating wall 22. The lamella structure 4 is formed by a groove 10 which extends into the separating wall 22 opposite the z-direction. As is indicated in FIG. 1, if two single emitters 1 are arranged next to each other in the y-direction, then two grooves are present between the emission openings (cavities) of the single emitters 1, one for each single emitter 1.

An interference site 3 in the form of a pin or a tab is arranged on each of the four separating walls 21, 22. The pin extends in the z-direction out from the separating walls 21, 22 and is centrally arranged. Thus, a periodic and symmetrical arrangement of the interference sites 3 is obtained via the antenna array.

A cavity is formed in the middle of the separating walls 21, 22 which is filled at least in part by a dielectric material 11, for example, polytetrafluoroethylene (PTFE) sold under the trademark TEFLON™, with a dielectric constant $\in>1$. This dielectric material 11 terminates approximately with the aperture and in one form fills the entire cavity, so that no contamination can settle down during operation of the antenna. The separating walls 21, 22 and the remaining structure of the single emitters 1 consist of a metal or are metal-coated.

Figure 3:
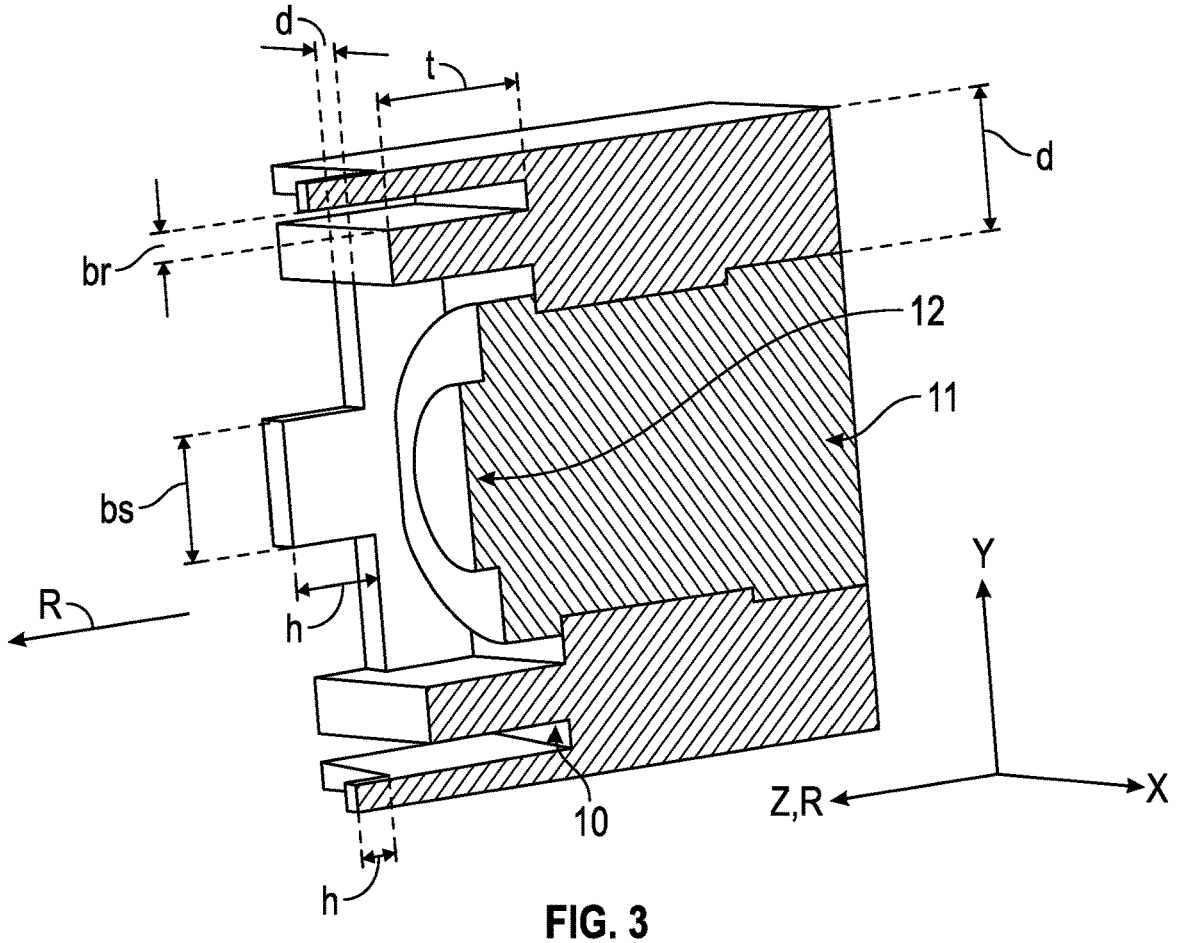
FIG. 3 is a perspective cross-sectional view of a single emitter, according to the teachings of the present disclosure.

According to FIG. 3 a height h of the interference sites 3 on the separating walls 21, 22 is similar, while the width bs of the interference sites 3 on the separating walls 21, 22 is different in the x- and y-direction. The height h herein amounts to less than λ/4 and is at least λ/10. On the separating wall 22 in the y-direction the interference sites 3 are arranged on the outer lamella of the single emitter midpoint. Thus, for the x- and y-direction only one interference site 3 is provided between two neighboring single emitters 1; each single emitter 1 "is divided to" each of the interference sites 3 with the neighboring single emitters 1. If desired, interference sites 3 on the separating wall 22 in the y-direction can be omitted.

A width br of the groove 10 amounts to about λ/10, a depth t of the groove 10 amounts to about one-third of the width br of the groove, thus λ/30. The single emitter 1 is not shaped as a horn radiator with a funnel, but rather as an open waveguide section, so that the waveguide is not expanded and features a similar cross-section across the length of the single emitter 1. In the z-direction a protrusion 12 is formed on the dielectric material 11; this protrusion features a particular height and a particular diameter, which results from improved adjusting of the impedance of the antenna to the emission in free space.

Figure 4:
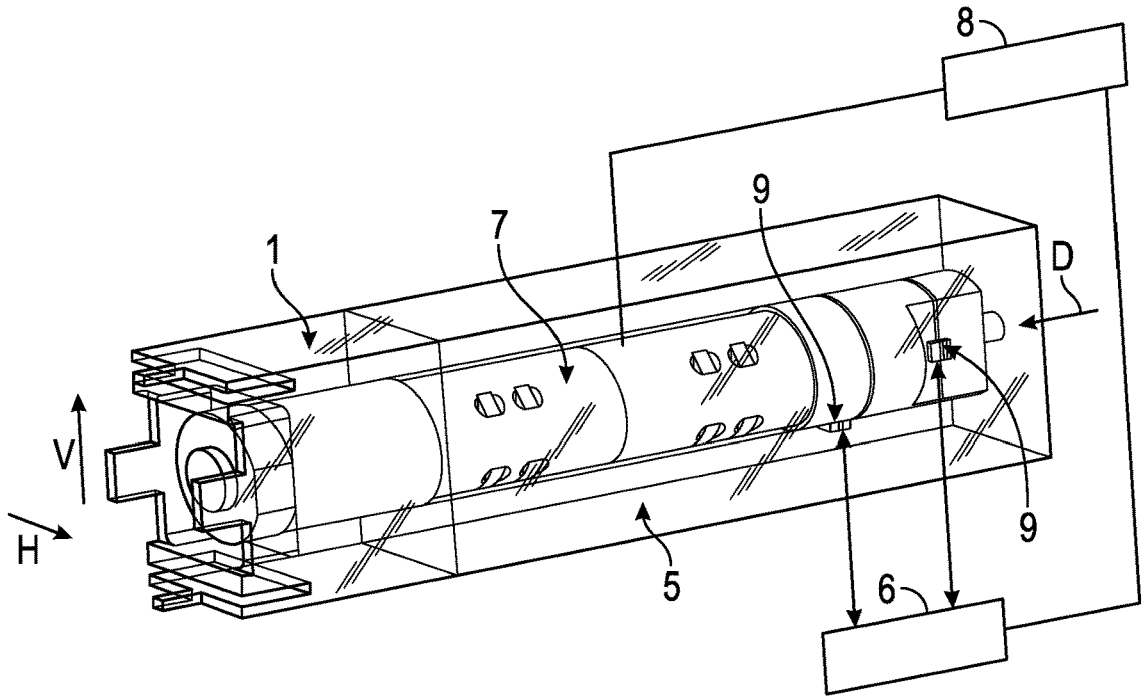
FIG. 4 is a perspective view of a single emitter with a phase control element and a power supply in the background, according to the teachings of the present disclosure.

FIG. 4 shows the single emitter 1 from FIGS. 2 and 3 in a cross-sectional representation in which the open waveguide piece continues seamlessly in a power supply 5, which in turn comprises a waveguide. Both mutually aligned waveguides are round waveguides, so that as an additional possibility it turns out that a phase control element 7 is arranged to rotate in the round waveguide. The phase control element 7 is arranged near the single emitter 1 and is designed according to the provisions of DE 10 2016 112 583 A1. The phase control element 7 is arranged so as to rotate about an axis of rotation D, thus is also designed as rotation-symmetrical.

Two couplings 9 within the power supply 5 adjoin with the phase control element 7. These couplings 9 are used to inject separate signals into the waveguide for two separate, mutually orthogonal polarizations, for example a horizontal polarization H, and a vertical polarization V. In one form, the couplings 9 are rotated by 90° to each other, and thus are arranged perpendicular to each other in the waveguide. From the couplings 9 the signals with both polarizations V, H are guided via microstrip lines and waveguide to a sending/receiving device 6 in the case of reception, or in the case of transmission, the signals of both polarizations V, H are emitted from the sending/receiving device 6 via the couplings 9 into the waveguide and the single emitter 1.

Since the single emitter 1 according to FIG. 4 can be viewed as one of many elements of the antenna array, see FIG. 1, the power supply 5 also has the function of summing up the signals from the plurality of single emitters and to guide this signal sum to the sending/receiving device 6.

In addition, the antenna features a control device 8 which is connected both to the phase control element 7 and also to the sending/receiving device 6. Thus, it is possible for the control device 8 to deflect the emission characteristic in the x-direction by adjusting the different phase positions of the signals to the neighboring single emitters 1, here: the single emitters 1 neighboring in the x-direction.

In this regard the phase difference between neighboring single emitters is:

$$\Delta\phi = \frac{2\pi}{\lambda} d \sin\theta_0.$$

A deflection in the y-direction is not provided. Thus, in conjunction with a rotation of the antenna aperture on the turntable 13 (and possibly in conjunction with a slight tilting of the antenna aperture) the emission characteristic can be aligned to any particular angle. Thus, in the case of an antenna mounted onto an aircraft, an exceptionally compact design is now possible which is flat due to the absence of large-volume tipping elements and a voluminous radome can be omitted. At the same time, due to the structure of the interference sites and the lamella structure 4, interfering resonances in the aperture surface are avoided, so that a high efficiency and thus a maximum antenna gain are obtained, even over large pivot ranges of the emission characteristic.

It is difficult to integrate a power supply 5 due to the small spacing between the single emitters 1. Due to the greater spacing between the single emitters 1 in the y-direction and due to the large-area emission resulting from the lamella structure 4 and the short, open waveguide pieces instead of horn radiators, it was possible to integrate the power supply 5 into a small assembly space and still to keep the antenna gain high.

Unless otherwise expressly indicated herein, all numerical values indicating mechanical/thermal properties, compositional percentages, dimensions and/or tolerances, or other characteristics are to be understood as modified by the word "about" or "approximately" in describing the scope of the present disclosure. This modification is desired for various reasons including industrial practice, material, manufacturing, and assembly tolerances, and testing capability.

As used herein, the phrase at least one of A, B, and C should be construed to mean a logical (A OR B OR C), using a non-exclusive logical OR, and should not be construed to mean "at least one of A, at least one of B, and at least one of C."

The description of the disclosure is merely exemplary in nature and, thus, variations that do not depart from the substance of the disclosure are intended to be within the scope of the disclosure. Such variations are not to be regarded as a departure from the spirit and scope of the disclosure.

What is claimed is:

1. An antenna comprising:

a plurality of single emitters arranged in an x-direction and a y-direction to form an antenna array with an aperture, and phase control elements disposed in a power supply, wherein the phase control elements are configured to control a phase of at least a portion of the plurality of single emitters of the antenna array, wherein each of the plurality of single emitters are separated by separating walls, the separating walls extending in the x-direction and the y-direction, and at least a portion of each of the separating walls comprising an interference site protruding out from the aperture, and wherein the separating walls extending in the x-direction have a wall thickness different from a wall thickness of the separating walls extending in the y-direction, and single emitters arranged in the x-direction have a spacing of less than a wavelength A at a maximum operating frequency.

2. The antenna according to claim 1, wherein at least a portion of the plurality of single emitters are arranged such that a greater number of single emitters are arranged in the x-direction than in the y-direction.

3. The antenna according to claim 1, wherein the single emitters in the y-direction further comprise a lamella structure in the separating wall extending in the x-direction.

4. The antenna according to claim 3, wherein the lamella structure includes a groove with a depth of less than $\lambda/4$ and greater than $\lambda/20$.

5. The antenna according to claim 4, wherein the depth is less than $\lambda/8$ and greater than $\lambda/12$.

6. The antenna according to claim 5, wherein the depth is about $\lambda/10$.

7. The antenna according to claim 3, wherein the lamella structure defines a groove with a width of less than $\lambda/10$ and greater than $\lambda/50$.

8. The antenna according to claim 7, wherein the width is less than $\lambda/20$ and greater than $\lambda/40$.

9. The antenna according to claim 8, wherein the width is about $\lambda/30$.

10. The antenna according to claim 1, wherein the interference sites of the separating walls in the x-direction are wider than interference sites of the separating walls in the y-direction.

11. The antenna according to claim 1, wherein the antenna array is connected by the power supply to a sending/receiving device.

12. The antenna according to claim 1 further comprising a control device, wherein the control device controls the phase control elements such that a deflection of one emission characteristic occurs predominately in the x-direction.

13. The antenna according to claim 1, wherein the phase control elements are arranged near the plurality of single emitters.

14. The antenna according to claim 1, wherein the plurality single emitters are open waveguides.

15. The antenna according to claim 14, wherein the plurality of single emitters are open round waveguides connected to the power supply, and wherein the power supply is a plurality of round waveguides.

16. The antenna according to claim 1, wherein at least a portion of the plurality of single emitters is filled with a dielectric material.

17. The antenna according to claim 16, wherein the dielectric material defines a rotation-symmetrical shape and is disposed along an axis of emission of each single emitter.

18. The antenna according to claim 17, wherein the dielectric material defines a protrusion extending in a direction of the aperture.

19. The antenna according to claim 1, further comprising a turntable on which the antenna array is arranged as being flat.

20. The antenna according to claim 1, wherein at least the plurality of single emitters of the antenna array are connected by the power supply to a sending/receiving device, wherein the sending/receiving device injects two signals of different polarization into the power supply.

* * * * *